US005672997A

United States Patent [19]

Shield

[11] Patent Number: 5,672,997

[45] Date of Patent: Sep. 30, 1997

[54] METHOD AND APPARATUS FOR REDUCING THE NOMINAL OPERATING VOLTAGE SUPPLIED TO AN INTEGRATED CIRCUIT

[75] Inventor: David J. Shield, El Dorado Hills, Calif.

[73] Assignee: Intel Corporation, Santa Clara, Calif.

[21] Appl. No.: 583,536

[22] Filed: Jan. 5, 1996

Related U.S. Application Data

[63] Continuation of Ser. No. 309,751, Sep. 21, 1994, abandoned.

[51] Int. Cl.[6] ..... G05F 1/10

[52] U.S. Cl. ..... 327/538; 327/540; 327/332

[58] Field of Search ..... 327/54, 56, 65, 327/67, 77, 82, 87, 323, 332, 362, 379, 380, 551, 538, 540, 544, 541, 530; 365/227

[56] References Cited

U.S. PATENT DOCUMENTS

| | | | |
|---|---|---|---|
| 3,585,510 | 6/1971 | O'Malley | 327/77 |
| 4,403,183 | 9/1983 | Lueker | 327/77 |
| 5,191,235 | 3/1993 | Hara | 327/82 |
| 5,343,088 | 8/1994 | Jeon | 327/536 |

*Primary Examiner*—Timothy P. Callahan
*Assistant Examiner*—Jung Ho Kim
*Attorney, Agent, or Firm*—Blakely, Sokoloff, Taylor & Zafman

[57] ABSTRACT

Apparatus for reducing the operating voltage for an integrated circuit. The integrated circuit includes a first input conductor coupled to an operating voltage and a second input conductor coupled to system ground. A logic circuit having a positive rail and a negative rail is coupled between the first input conductor and the second input conductor such that the positive rail is coupled to the first input conductor via a first impedance and the negative rail is coupled to the second input conductor via a second impedance. A first sense conductor is connected to said positive rail between said first impedance and said logic circuit for sensing the voltage at the positive rail. In this manner, the potential at the positive rail of the logic device is accurately sensed. The integrated circuit may be incorporated in a remote sensing system wherein a remote sense conductor of the power supply is coupled to sense the potential at the positive rail. The power supply may thus adjust its output voltage in response to the voltage sensed at the logic circuit.

15 Claims, 7 Drawing Sheets

METHOD AND APPARATUS FOR REDUCING THE NOMINAL OPERATING VOLTAGE SUPPLIED TO AN INTEGRATED CIRCUIT

This is a continuation of application Ser. No. 08/309,751, filed Sep. 21, 1994, now abandoned.

FIELD OF THE INVENTION

The present invention relates generally to the regulation of power supplies and more particularly to the selection of remote sense points at a load to accurately sense the power requirements at the load.

BACKGROUND OF THE INVENTION

Many modern microprocessors and other integrated circuits consume less power than prior integrated circuits of similar scale and functionality. For some integrated circuits, reduced power consumption has been achieved through the development of logic devices that require a reduced minimum operating voltage when compared to the technologies of the prior art. The power consumption of a device is proportional to the square of the operating voltage supplied to the device.

As a practical matter, the nominal voltage for an integrated circuit as specified by the manufacturer of the integrated circuit typically exceeds the minimum operating voltage of the integrated circuit by an operating margin voltage, wherein the minimum operating voltage is the voltage level below which the transistors or logic of an integrated circuit will not operate. To better ensure continuous operation of the integrated circuit under different operating conditions, the manufacturer of the integrated circuit selects the operating margin voltage to account for voltage drops in the integrated circuit and voltage drops at the electrical interface between the package containing the integrated circuit and the integrated circuit. The value of the operating margin voltage is also selected to account for inaccuracies of the testing equipment that rates the voltage at which chips continue to operate.

The value of the operating margin voltage becomes increasingly significant as the minimum operating voltage of an integrated circuit decreases. For example, the minimum operating voltage of an integrated circuit may be 2.3 volts, but the nominal voltage delivered to the integrated circuit to ensure continuous operation is 2.85 volts such that the operating margin voltage is 0.55 volts, or approximately 20% of the nominal voltage. Of the 0.55 volts of operating margin provided, 100 mV account for "on-chip losses,"200 mV account for "package losses," and 250 mV account for tester errors. Wherein improvements in semiconductor processes may result in a further reduction of the minimum operating voltage, the voltage drops described above do not necessarily decrease in a similar manner. Therefore, the operating margin voltage may be a larger percentage of the nominal voltage as the minimum operating voltage decreases.

Voltage drops in the integrated circuit are often referred to as "on-chip losses" and include voltage drops due to the inherent impedances of the semiconductor material from which the die is manufactured. As on-chip losses can vary for each semiconductor die manufactured according to the same integrated circuit design, the portion of the operating margin voltage attributable to on-chip losses is typically an approximation based on a theorized worst-case semiconductor die. The actual on-chip losses of a particular semiconductor die may, in fact, be much less than the worst-case on-chip losses that are accounted for by the operating margin voltage, which means that the voltage supplied to such a semiconductor die could be reduced below the nominal voltage if the actual on-chip losses were known, resulting in the reduction of power consumption for that integrated circuit.

Voltage drops at the electrical interface between the package containing the integrated circuit and the integrated circuit are often referred to as "package losses" and include voltage drops due to the impedance of the bond wires, the impedance of the package leads, the interface between the bond wires and the semiconductor die, the interface between the bond wires and the package leads, and the interface between the pin of a package and the printed circuit board. Like on-chip losses, package losses are accounted for by increasing the value of the operating margin voltage using an approximation made in view of a theorized worst-case chip. The actual package losses of a particular semiconductor die may be less than the worst-case package losses that are accounted for by the operating margin voltage, which means that the voltage supplied to such a semiconductor die could be reduced below the nominal voltage if the actual package losses were known.

SUMMARY AND OBJECTS OF THE INVENTION

It is therefore one object of the present invention to provide an apparatus for reducing the operating margins such that the voltage delivered to an integrated circuit may be reduced.

It is another object of the present invention to provide for on-chip regulation of the power supply.

These and other objects of the invention are provided by an integrated circuit that includes a first input conductor coupled to an operating voltage and a second input conductor coupled to system ground. A logic circuit having a positive rail and a negative rail is coupled between the first input conductor and the second input conductor such that the positive rail is coupled to the first input conductor via a first impedance and the negative rail is coupled to the second input conductor via a second impedance. A first sense conductor is coupled to the positive rail between said first impedance and the logic circuit for sensing the voltage at the positive rail. A second sense conductor may be coupled to the negative rail between the second impedance and the logic circuit for sensing a second voltage at the negative rail. The integrated circuit may be incorporated in a remote sensing system wherein a remote sense conductor of the power supply is coupled to sense the potential at the positive rail. The power supply may thus adjust its output voltage in response to the voltage sensed at the logic circuit.

Other objects, features, and advantages of the present invention will be apparent from the accompanying drawings and from the detailed description which follows below.

BRIEF DESCRIPTION OF THE DRAWINGS

The present invention is illustrated by way of example and not limitation in the figures of the accompanying drawings, in which like references indicate similar elements, and in which.

DETAILED DESCRIPTION

As described below, active feedback is used to reduce the operating margin voltage such that the voltage delivered to an integrated circuit and the power consumption of the integrated circuit may be reduced. According to typical prior systems, active feedback is used by power supplies to compensate for voltage drops due to the impedances of the conductors via which power is transmitted to a load, which may be an integrated circuit. A power supply may include circuitry that compensates for such voltage drops by remotely sensing the voltage delivered at the load. The sensed voltage is typically compared to an internal voltage reference of the power supply. If the voltage at the integrated circuit is different than the internal voltage reference, the power supply adjusts its output voltage, either upwards or downwards, until the sensed voltage is equal to the internal voltage reference. Wherein "remote sensing" is useful to compensate for voltage drops between the power supply and the integrated circuit, remote sensing has not been used to compensate for package and on-chip losses because the point in the conduction path at which the voltage is sensed is external to the package and the chip. As described below, package and on-chip losses can be compensated for by using remote sensing if the sense points are selected to be internal to the integrated circuit, rather than at the voltage input pins of the integrated circuit. By sensing the voltage at the logic of the integrated circuit, a reduced voltage at the logic can be sensed and directly compensated for by the power supply. The operating margin voltage no longer needs to include approximations of on-chip and package losses because the on-chip and package losses are accounted for through the use of feedback.

Figure 1:
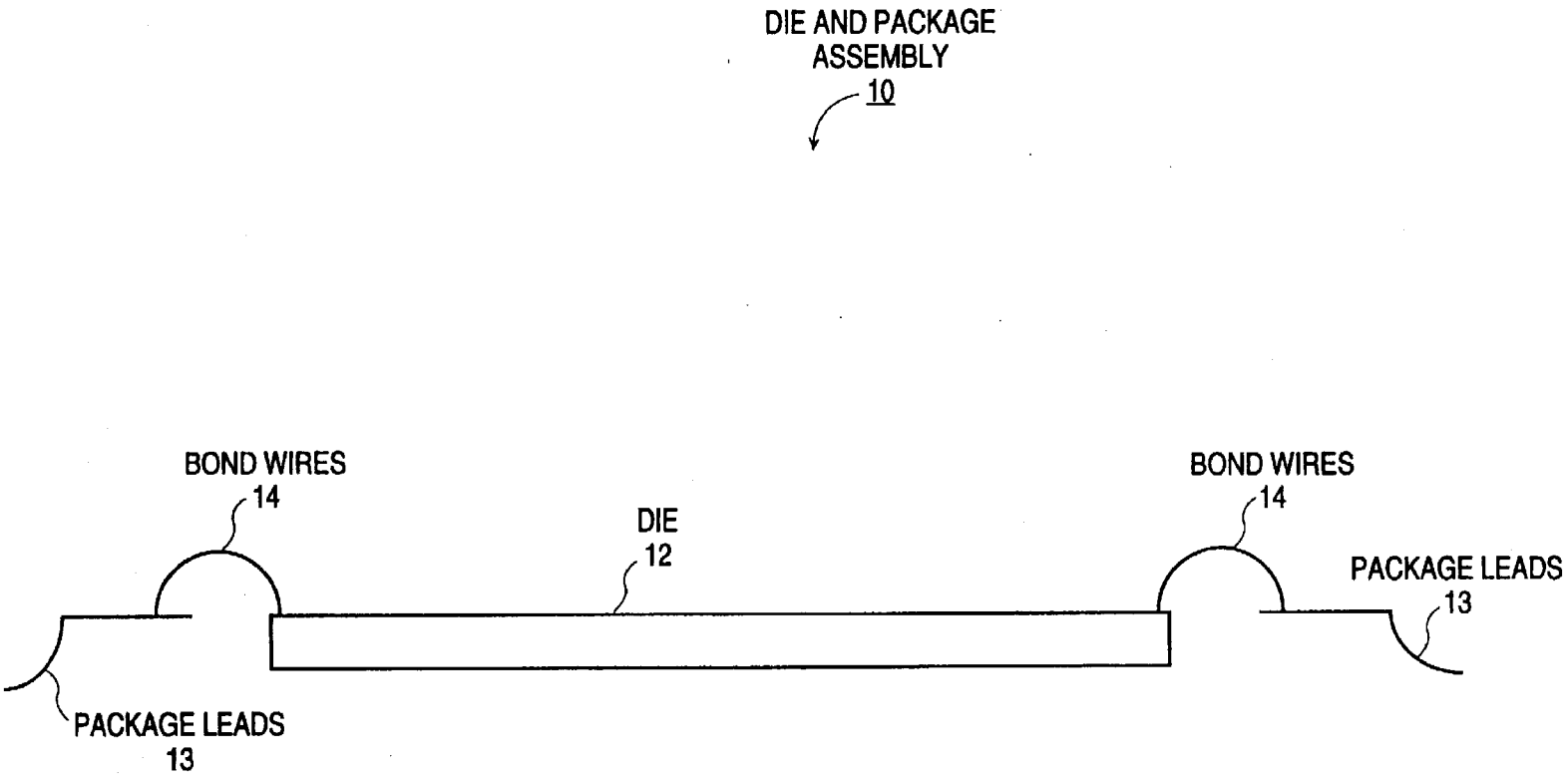
FIG. 1 shows a cross-section of a semiconductor die and package assembly.

FIG. 1 shows a cross-section of a semiconductor die and package assembly. The die and package assembly 10 is only represented by the conduction paths between a power supply (not shown) and the die. The die and package assembly 10 includes a semiconductor die 12 which is connected to package leads 13 via bond wires 14. On-chip losses occur in the die 12. Package losses occur at the package leads 13 and bond wires 14 that connect the die 12 to the power supply. There also may be interface losses due to the connection between the package leads 13 and the printed circuit board (not shown).

Figure 2:
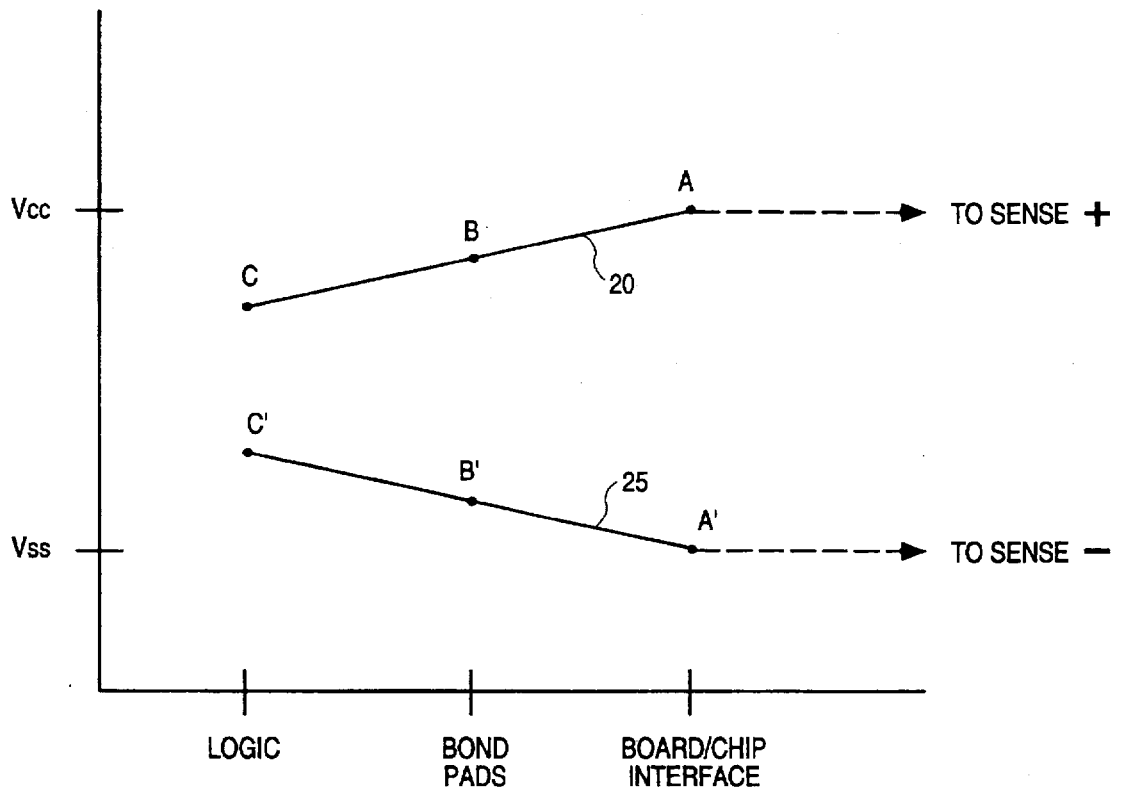
FIG. 2 (PRIOR ART)
FIG. 2 is a graph of voltage versus position on the conductive path from the power supply to the logic of the semiconductor die.

FIG. 2 shows on-chip and package losses as a function of voltage versus position on the conduction path between the package leads 13 and the logic of the semiconductor die 12. Curve 20 shows the losses for the positive supply voltage, which is $V_{CC}$, from the package leads 13 to the logic of the semiconductor die 12 (right to left). Curve 25 shows the losses for the negative supply voltage, which, in this case, is system ground $V_{SS}$, from the package leads 13 to the logic of the semiconductor die 12. For purposes of illustration, curves 20 and 25 show a linear relationship between voltage and position on the conductive path. There may actually be some non-linearity in the curves 20 and 25 due to stray capacitances and inductances.

Points A and A' of curves 20 and 25, respectively, show the voltages at the package leads 13 that are coupled to $V_{CC}$ and $V_{SS}$, respectively. The conductor coupled to $V_{CC}$ is part of the "positive" conduction path, and the conductor coupled to $V_{SS}$ is part of the "negative" conduction path. The terms "positive" and "negative" as used herein merely indicate that the potential at the positive conduction path is nominally greater than the potential at the negative conduction path. As shown, the voltage drop across the positive and negative conduction paths at the package leads is equal to $V_{CC}$ minus $V_{SS}$.

Points B and B' show the voltages at the bond pads of the semiconductor die 12. Bond pads (not shown) of the semiconductor die 12 are coupled to the package leads 13 via the bond wires 14. As shown, the voltage at point B is less than the voltage at point A. Similarly, the voltage at point B' is greater than the voltage at point A'. Thus, the voltage drop across the positive and negative conduction paths at the bond pads of the semiconductor die 12 is less than $V_{CC}$ minus $V_{SS}$. The difference in the voltage across the positive and negative conduction paths at points A and A' and the voltage across the positive and negative conduction paths at points B and B' represents the package losses for the integrated circuit.

Points C and C' show the voltages as received by the logic of the semiconductor die 12. Points C and C' represent a worst case scenario, as the voltages received at a particular logic circuit of the semiconductor die 12 depends on the loading of the supply rails and the position of the logic device on the die. For example, a logic device at the center of the semiconductor die has more on-chip losses due to the increased amount of semiconductor material the power signal must travel through to supply power to the logic device. The difference in the voltage across the positive and negative conduction paths at points B and B' and the voltage across the positive and negative conduction paths at points C and C' represents the on-chip losses for the integrated circuit.

Prior remote sensing schemes typically sense the voltages at the package leads 13, which are represented by points A and A'. Thus, typical prior sensing schemes do not detect the voltage drops due to package and on-chip losses which occur later in the positive and negative conduction paths. Package and on-chip losses of an integrated circuit have therefore been "compensated" for by the manufacturer of the integrated circuit specifying a nominal voltage that must be supplied to the integrated circuit to ensure continued operation. The nominal voltage includes an operating margin voltage having a value based on a worst-case device. The voltage level that must be supplied to a particular integrated circuit to ensure continued operation of that integrated circuit may be less than the voltage actually supplied, in which case the excess voltage results in unnecessary power consumption.

Figure 3:
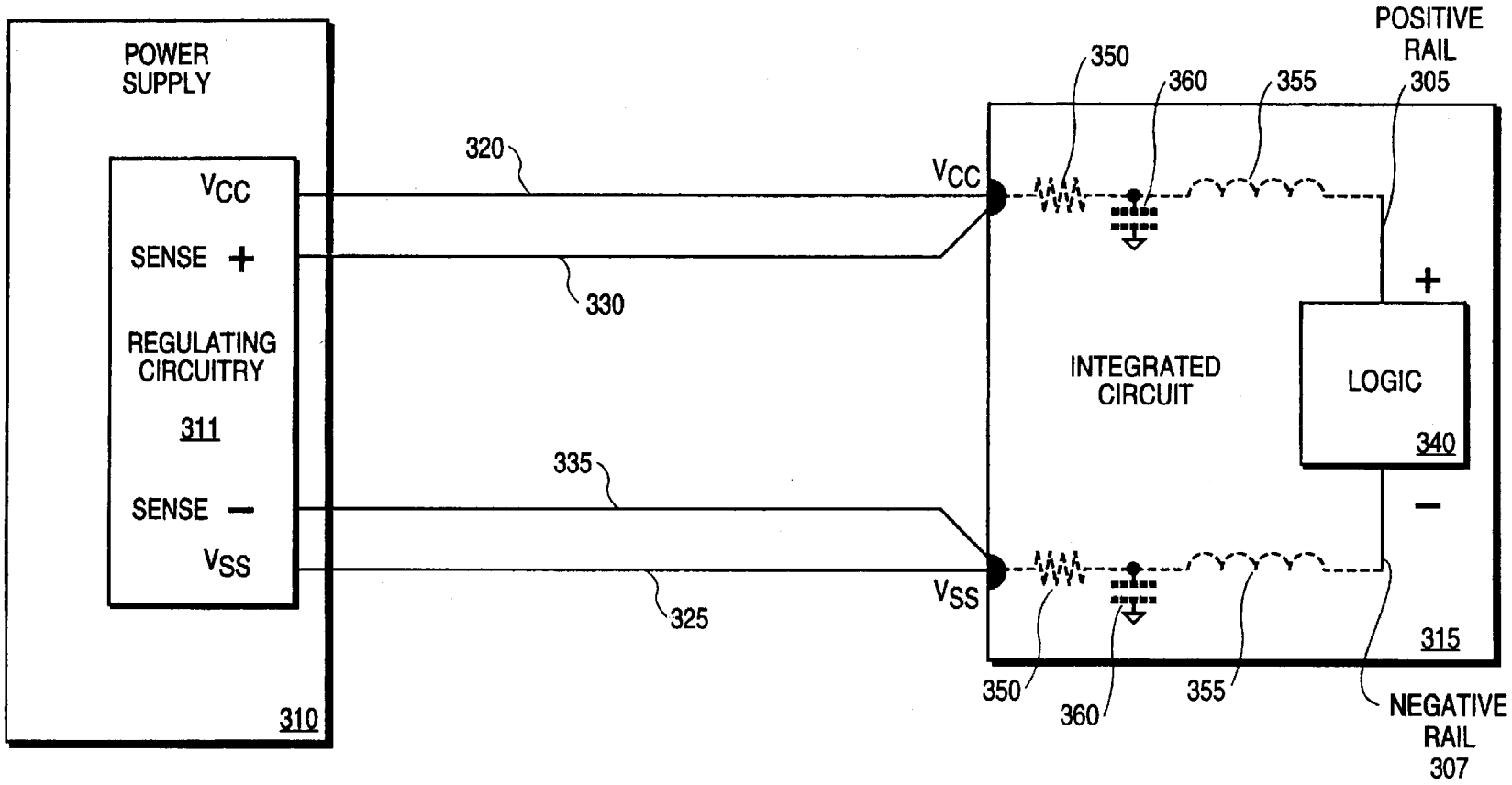
FIG. 3 (PRIOR ART)
FIG. 3 shows a prior art remote sensing circuit.

FIG. 3 shows a prior art remote sensing circuit that comprises a power supply 310 which is connected to an integrated circuit 315. The power supply 310 includes a $V_{CC}$ output pin which supplies the operating voltage signal $V_{CC}$ to the integrated circuit 315 via supply output line 320. The power supply 310 also includes a $V_{SS}$ output pin which supplies a system ground voltage signal $V_{SS}$ to the integrated circuit 315 via ground line 325. The power supply 310 also includes sense+ and sense− input pins that are coupled to $V_{CC}$ and $V_{SS}$ input pins, respectively, of the integrated circuit 315 via the high sense line 330 and the low sense line 335, respectively. The sense+ and sense− input pins are coupled to regulating circuitry 311, which compares the difference in potential between the sense lines to a known reference voltage. As defined herein, a "pin" is simply a conductor.

The input impedance of the regulating circuitry 311 is very large such that the conduction paths from the sense lines to the sense+ and sense− pins of the power supply 310 appear to be open circuits when compared to the impedance of the load. Therefore, little or no current flows through the sense lines. The reference voltage is typically set to be equal to the $V_{CC}$ minus $V_{SS}$. This prior scheme for remote sensing at the inputs of the integrated circuit 315 compensates for voltage drops due to the impedances of the supply output and system ground lines 320 and 325 by adjusting the voltage at the power supply output pins such that the voltage sensed across the $V_{CC}$ and $V_{SS}$ input pins of the integrated circuit 315 is equal to $V_{CC}$ minus $V_{SS}$. However, on-chip and package impedances, which are shown in FIG. 3 as resistors 350, inductors 355, and capacitors 360, are not detected. Thus, the output of the power supply 310 is not increased to compensate for such losses due to the on-chip and package impedance.

Integrated circuit 315 is shown as including a logic circuit 340 having a positive rail 305 which is coupled to $V_{CC}$. The logic circuit 340 also includes a negative rail 307 which is coupled to system ground $V_{SS}$. The resistors 350, inductors 355, and capacitors 360 shown as being included in integrated circuit 315 represent the impedances associated with on-chip and package losses and are not actual devices in the integrated circuit 315. The impedances associated with the semiconductor material between the $V_{CC}$ input pin and the logic 340 result in the positive rail of the logic circuit 340 receiving an input voltage that is below the nominal value of $V_{CC}$. The resistance associated with the $V_{SS}$ input pin results in the negative rail being at a voltage that is above system ground $V_{SS}$. The difference in potential between the positive and negative rails, which defines the operating voltage of the integrated circuit, is thus reduced. If the difference in potential drops below a minimum level, the logic circuit 140 does not operate.

Figure 4A:
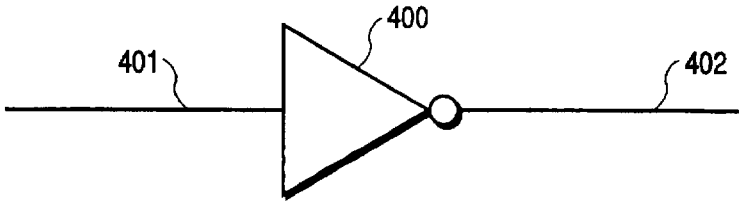
FIG. 4a (PRIOR ART)
FIG. 4A shows a prior art inverter circuit.
Figure 4B:
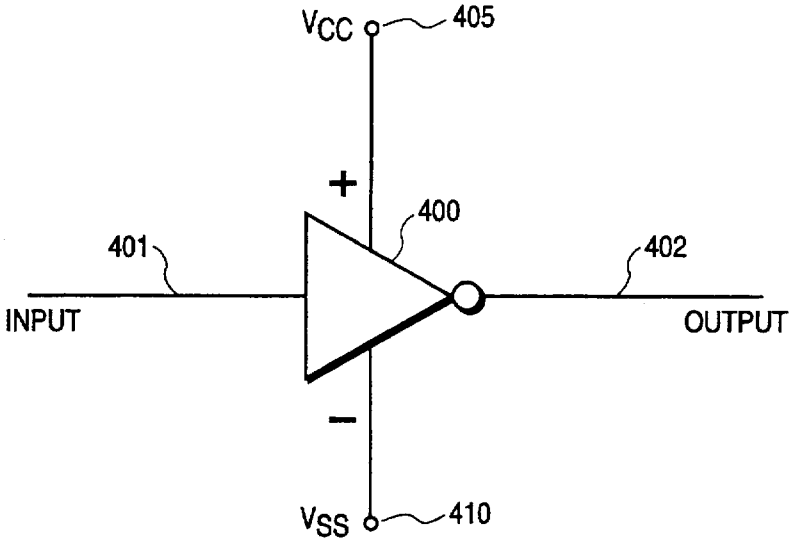
FIG. 4b (PRIOR ART)
FIG. 4B shows a prior art inverter circuit.
Figure 4C:
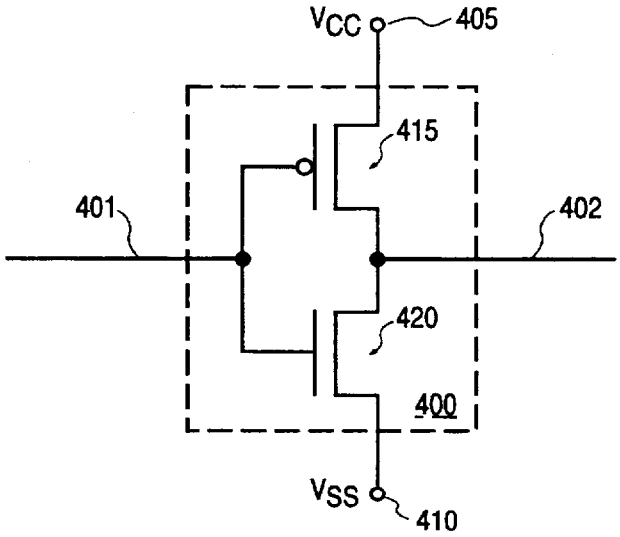
FIG. 4c (PRIOR ART)
FIG. 4C shows a prior art inverter circuit.

Each of FIGS. 4A, 4B, and 4C show a prior art logic inverter. FIG. 4A shows the inverter 400 having an input 401 and an output 402. FIG. 4B shows the inverter 400 as having a positive rail 405 and a negative rail 410. The positive rail 405 is coupled to the operating voltage $V_{CC}$ while the negative rail 410 is coupled to system ground $V_{SS}$. FIG. 4C shows the inverter 400 at the transistor level of a complementary metal oxide semiconductor (CMOS) integrated circuit. The inverter 400 includes p-channel field effect transistor ("FET") 415 and n-channel FET 420. The input 401 of the inverter 400 is connected to both the gate of p-channel FET 415 and the gate of n-channel FET 420. The output 402 is coupled to a node defined by the connection between the drain of p-channel FET 415 and the source of n-channel FET 420.

Typically, most logic gates such as OR gates, AND gates, NOR gates, NAND gates, etc., similarly include a combination of n-channel and p-channel transistors which are coupled to a positive rail and a negative rail. Hereinafter, the term "logic circuit" will be understood to refer to any such logic device or circuit which, when implemented at the transistor level, includes a positive rail and a negative rail such as those shown in FIGS. 4A, 4B and 4C.

Figure 5:
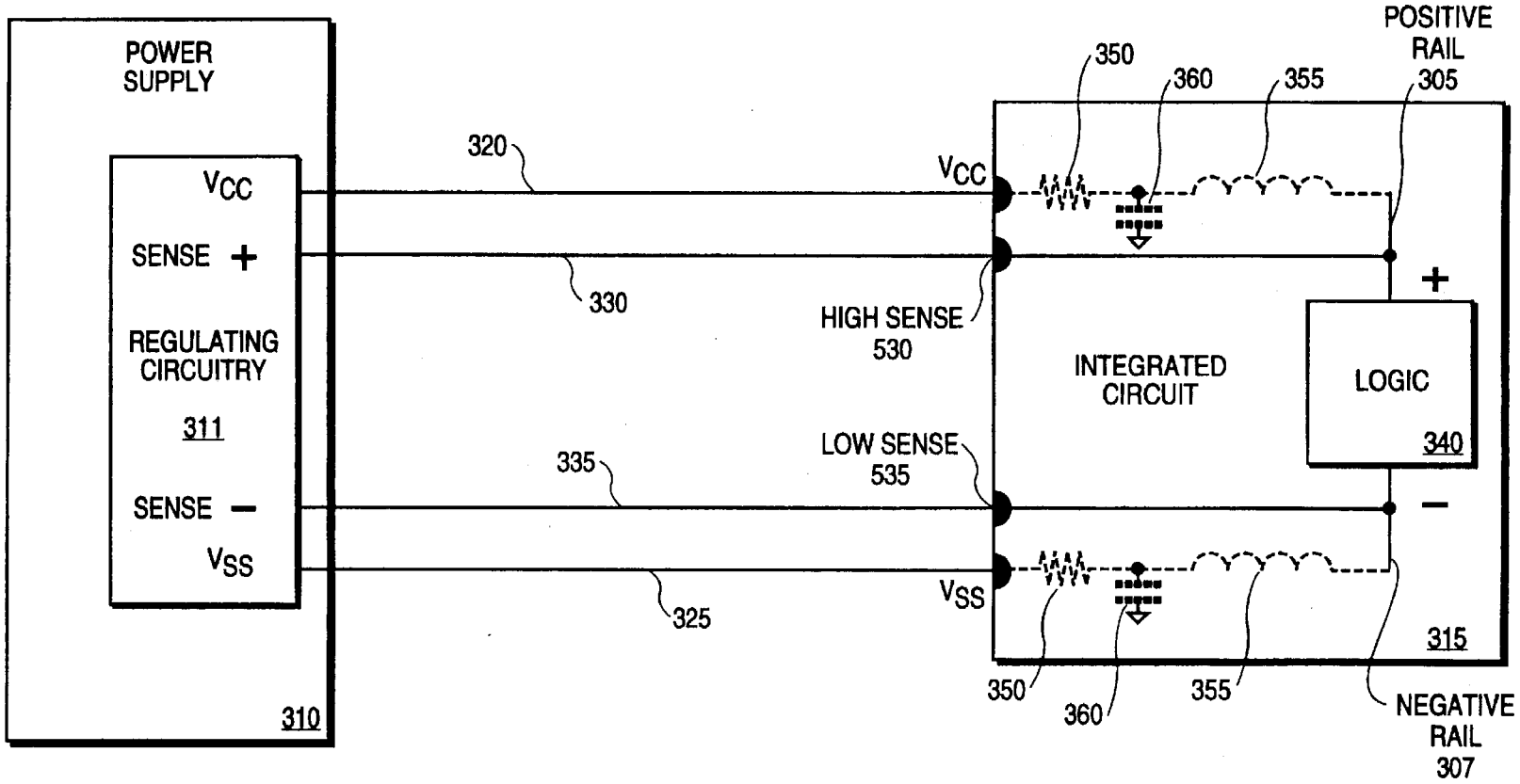
FIG. 5 shows a remote sensing circuit according to one embodiment.

FIG. 5 shows a remote sensing circuit that may be incorporated in a computer system to regulate the voltage supplied to the integrated circuit 315. The remote sensing circuit includes a power supply 310 which is connected to an integrated circuit 315 via supply output line 320, system ground line 325, high sense line 330, and low sense line 335. Wherein the integrated circuit 315 is a processor, the remote sensing circuit of FIG. 5 may be used to sense and adjust the voltage at the core of the processor. The integrated circuit 315 includes the logic circuit 340 which is coupled to $V_{CC}$ via a positive rail 305 and to $V_{SS}$ via a negative rail 307. Unlike the prior art, the integrated circuit 315 includes a high sense pin 530 and a low sense pin 535. As shown, the high sense pin 530 is connected directly to the positive rail of logic circuit 340 with no intervening impedance device. Similarly, low sense pin 535 is connected to the negative rail of logic circuit 340 with no intervening impedance device. The impedances associated with the semiconductor material and the various package interfaces may be ignored as there is little or no current flow from the sense pins 535 and 530 to the sense− and sense+ pins of the power supply 310. This embodiment requires that integrated circuit 315 includes two additional output pins, the high sense pin 330 and the low sense pin 335.

As shown, the sense lines of the power supply 310 are not coupled to the load presented by the entire integrated circuit 315. The sense lines of the power supply 310 are instead coupled directly to the critical points of the integrated circuit 315, such that the difference in potential between the positive and negative rails of the logic circuit 340 can be accurately sensed. Because no appreciable current flows from the sense points to the sense+ and sense− pins of the power supply 310, there is virtually no on-chip or package losses associated with the internal sense paths of integrated circuit 315. Therefore, the conductive traces from the sense points to the sense pins of the integrated circuit 315 are shown as short circuits with no intervening impedances. Coupling the sense lines directly to the positive and negative rails effectively includes the portions of the positive and negative conduction paths that are within the integrated circuit 315 as part of the feedback loop such that the impedances associated with those portions of the conduction paths may be compensated for by the power supply 310.

As described above, the internal voltage reference used by the regulating circuitry 311 of the power supply 310 is typically set to be equal to the nominal voltage $V_{CC}$, which is equal to the minimum operating voltage plus the operating margin voltage. Because feedback is used to account for package and on-chip losses, the operating margin voltage is reduced by the amounts normally included to account for the package and on-chip losses. For the example described above, wherein the minimum operating voltage is 2.3 volts, the operating margin voltage is set to 250 mV to account for tester inaccuracies. The nominal voltage $V_{CC}$ is therefore equal to 2.55 volts rather than 2.85 volts, and the internal voltage reference of the regulating circuitry 311 is set to 2.55 volts. The operating margin voltage may be increased to account for inaccuracies of the power supply, which may include inaccuracies of the internal voltage reference. The actual voltage delivered to the integrated circuit 315 is determined by the package and on-chip losses of the integrated circuit 315. If the package and on-chip losses are less than the approximations previously incorporated into the prior operating margin voltage, a power savings is achieved.

The power supply 310 supplies the voltage $V_{CC}$ to the $V_{CC}$ input pin of the integrated circuit 315 via supply output line 320. Similarly, the $V_{SS}$ input pin of the integrated circuit 315 is coupled to the $V_{SS}$ output pin of the power supply 310 via system ground line 325. Initially, the output voltage $V_{CC}$ may be equal to the minimum operating voltage plus the operating margin voltage, which may comprise a tester guardband and a power supply guardband. The impedances associated with the semiconductor material of the die and the package interfaces attenuate the voltage signal supplied to the positive negative rails of the logic circuit 340 such that the voltage across the logic circuit 340 is less than the nominal voltage. The regulating circuitry 311 of the power supply 310 senses the voltage across the logic circuit 340 and compares it to the internal voltage reference. The power supply 310 increases the output voltage $V_{CC}$ until the voltage sensed across the logic 340 is equal to the internal reference voltage. The regulating circuitry 311 continuously monitors the voltage across the logic 340 and adjusts the output voltage $V_{CC}$ as required. By using active feedback to compensate for on-chip and package losses, continued operation of the logic 340 can be ensured without resorting to the use of approximations that may result in unnecessary power consumption.

Figure 6:
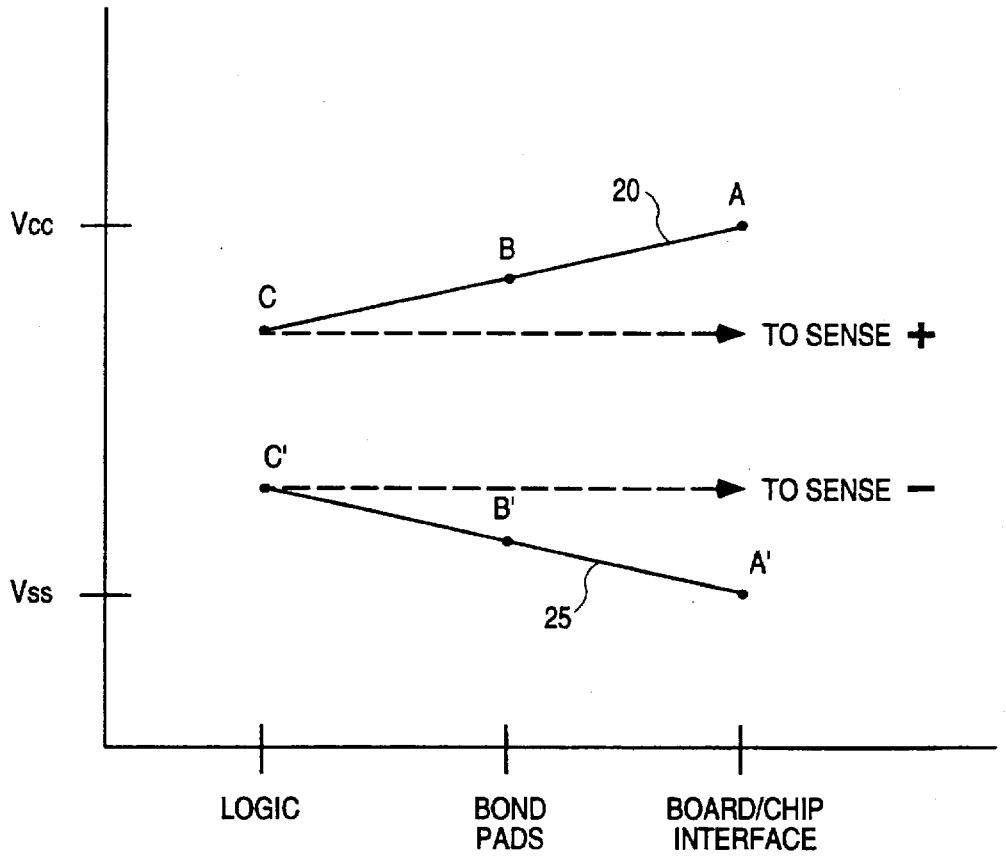
FIG. 6 is a graph of voltage versus position on the conductive path for a remote sensing circuit shown in FIG. 6.

FIG. 6 shows on-chip and package losses as a function of voltage versus position on the conduction paths between the power supply and the transistors of the integrated circuit, wherein the voltage drop sensed is the voltage drop from point C to point C'. To sense the voltage at the positive and negative rails, sense points are selected on the power and ground traces of the semiconductor die. The criteria for selecting sense points are described below. A conductive trace is routed from each sense point to a bond pad, to which a sense pin is coupled via a bond wire. To better ensure continued operation of the logic 340, sense points of the power and ground traces are selected to be those associated with a logic device having the smallest voltage drop between the positive and negative rails. Selection of the sense points is done in view of the loading of each branch of the power and ground traces and the relative location of a logic device on the semiconductor die.

The routing of power and ground traces within integrated circuits is very complex, and each branch of the $V_{CC}$ and $V_{SS}$ conduction paths may be presented with a different load. Typically, a logic device connected to a heavily loaded branch will have a smaller voltage drop between the positive and negative rails. Further, some integrated circuits can enter sleep modes wherein the power consumption of the integrated circuit is greatly reduced such that the load presented by such an integrated circuit varies over time. This effect should be accounted for when selecting sense points.

It is not necessary that both a high sense pin and a low sense pin be provided for processor 315. A common concern when designing an integrated circuit is that the number of output pins for any integrated circuit is typically limited. Further, bond pads require die space which may also be a limited resource. Therefore, a single bond pad and sense pin may be provided. The choice of which sense pin to provide is informed by the particular process and technology used in the fabrication of the processor 315. If only one sense pin is provided, the sense pin is chosen to be coupled to the rail that has associated with it the greatest on-chip losses.

Figure 7:
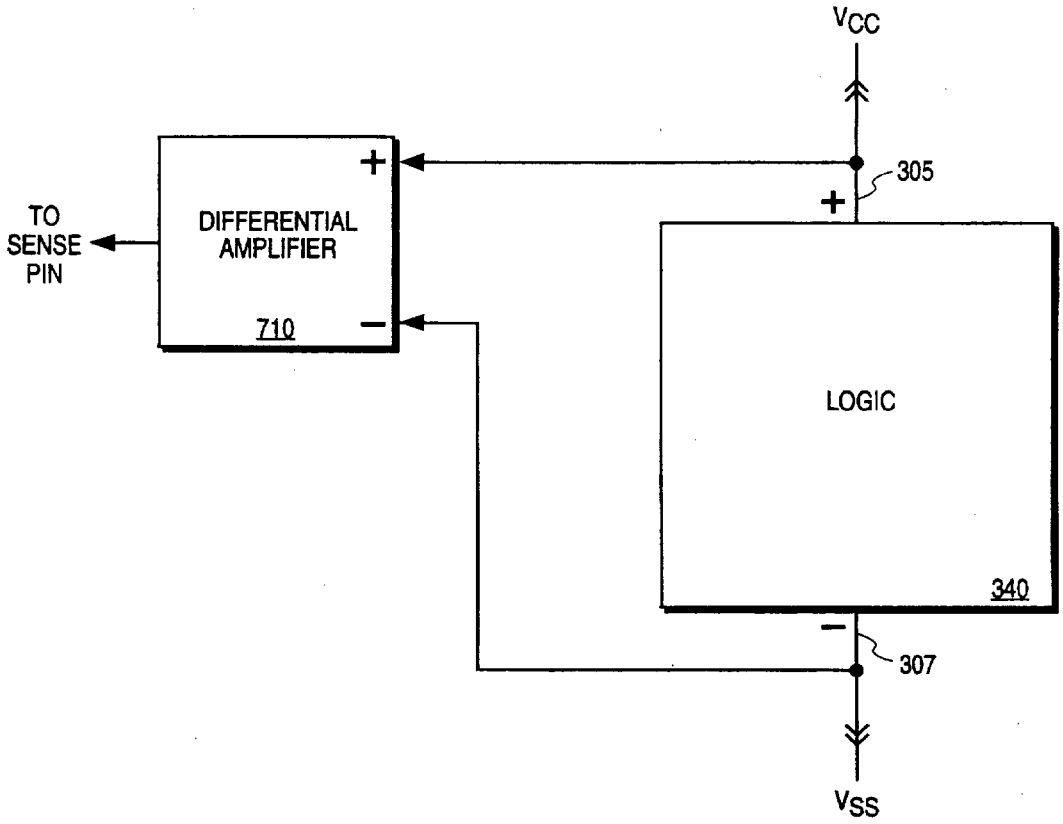
FIG. 7 shows an alternative embodiment having a differential amplifier for measuring the difference in voltage between the positive rail and the negative rail.

FIG. 7 shows an alternative embodiment which provides for the use of a single sense pin without a corresponding reduction in accuracy. Again, logic circuit 340 is shown as being coupled to the positive rail 305 and the negative rail 307. For this embodiment, the positive and negative rails are not directly connected to sense pins. Instead, a differential amplifier 710 has its positive input coupled to the positive rail 305 and a negative input coupled to the negative rail 307. The positive and negative inputs of the differential amplifier 710 present high impedance to the positive and negative rails such that no appreciable current flows into the positive and negative inputs. The differential amplifier 710 measures the difference in voltage between the positive rail and the negative rail. The difference in voltage is output to the sense pin. In this manner, the voltage drop across the logic circuit 340 may be accurately measured while using only a single sense pin.

For an alternative embodiment wherein C-4™ technology is used, the necessity to route a conductive trace to a bond pad is eliminated as no bond pads are required. C-4™ technology allows a bare semiconductor die to be directly connected to a printed circuit board. The top surface of the semiconductor die is provided with a number of conduction pads, each of which is connected to a trace of the printed circuit board via solder bump or similar connector. Unlike typical packaging technologies, the conduction pads for C-4™ technology may be provided anywhere on the top surface of the semiconductor die, not just at the outer periphery. The sense pad can therefore be placed as dose as possible to the sense point, reducing the length of the conductive trace between the sense point and the sense pad. This reduces the amount of die space necessary to implement the circuit of FIG. 5.

In the foregoing specification the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than restrictive sense.

What is claimed is:

1. An integrated circuit comprising:

a positive rail having a first position and a second position, wherein the first and second positions are separated by at least one parasitic element;

a negative rail having a first position and a second position, wherein the first and second positions are separated by at least one parasitic element;

a first input conductor connected at the first position of the positive rail, the first input conductor for coupling to a first external source to receive a first voltage;

a second input conductor connected at the first position of the negative rail, the second input conductor for coupling to a second external source to receive a second voltage, wherein the first voltage is greater than the second voltage;

a logic circuit powered by the first and second voltages and connected at the second position of the positive rail and at a second position of the negative rail; and a first sense conductor connected to the second position of the positive rail, the first sense conductor for coupling to an external circuit that senses a value of the first voltage at the logic circuit.

2. The integrated circuit of claim 1, the integrated circuit further comprising a second sense conductor coupled to the second position of the negative rail, the second sense conductor for coupling to an external circuit that senses a value of the second voltage at the logic circuit.

3. An integrated circuit comprising:

a positive rail having a first position and a second position, wherein the first and second positions are separated by at least one parasitic element;

a negative rail having a first position and a second position, wherein the first and second positions are separated by at least one parasitic element;

a first input conductor connected at the first position of the positive rail for receiving a first voltage from an external source;

a second input conductor connected at the first position of the negative rail for receiving a second voltage from another external source, wherein the first voltage is greater than the second voltage;

a circuit powered by the first and second voltages and connected at the second position of the positive rail and at the second position of the negative rail;

a differential amplifier having a first input coupled to the second position of the positive rail, a second input coupled to the second position of the negative rail, and an output that outputs a voltage that is equal to a difference between the first and second voltages as measured at the second positions of the positive and negative rails; and a first sense conductor connected to the output of the differential amplifier, the first sense conductor for coupling to an external circuit that senses a voltage drop across the logic circuit.

4. A remote sensing system comprising:

a power supply, the power supply including:

an output for outputting a supply voltage;

a remote sense conductor for sensing a value of the supply voltage;

regulating circuitry coupled to the output and the remote sense conductor, the regulating circuitry for comparing the value of the supply voltage sensed by the remote sense conductor to a reference voltage, wherein the regulating circuitry adjusts the supply voltage such that the voltage sensed by the remote sense conductor is equal to the reference voltage;

a supply output line coupled to the output of the power supply;

a remote sense line coupled to the remote sense conductor;

an integrated circuit comprising:

a positive rail having a first position and a second position, wherein the first and second positions are separated by at least one parasitic element;

a negative rail having a first position and a second position, wherein the first and second positions are separated by at least one parasitic element;

a first input coupled to the supply output line for receiving the supply voltage, the first input being connected at the first position of the positive rail;

a second input coupled to system ground, the second input being connected at the first position of the negative rail;

a logic circuit powered by the supply voltage and connected across the positive and negative rails at the second position of the positive rail and at the second position of the negative rail; and a first sense conductor connected to the remote sense line and to the second position of the positive rail, wherein the remote sense conductor of the power supply senses the value of the supply voltage at the second position of the positive rail.

5. The computer system of claim 4, the integrated circuit further comprising a second sense conductor coupled to the remote sensing circuitry and the second position of the negative rail.

6. A remote sensing system comprising:

a power supply, the power supply including:

an output or outputting a supply voltage;

a remote sense conductor for sensing a voltage;

regulating circuitry coupled to the output of the power supply and the remote sense conductor, the regulating circuitry for comparing a value of the supply voltage sensed by the remote sense conductor to a reference voltage, wherein the regulating circuitry adjusts the supply voltage such that the value of the supply voltage sensed by the remote sense conductor is equal to the reference voltage;

a supply output line coupled to the output of the power supply;

a remote sense line coupled to the remote sense conductor;

an integrated circuit formed on a semiconductor substrate comprising:

a positive rail having a first position and a second position, wherein the first and second positions are separated by at least one parasitic element;

a negative rail having a first position and a second position, wherein the first and second positions are separated by at least one parasitic element;

a first input coupled to the supply output line for receiving the supply voltage, the first input being connected at the first position of the positive rail;

a second input coupled to system ground, the second input being connected at the first position of the negative rail;

a logic circuit powered by the supply voltage and connected at the second position of the positive rail and at the second position of the negative rail;

a first differential amplifier having a first input connected at the second position of the positive rail, a second input connected at the second position of the negative rail, and an output, the differential amplifier outputting a voltage that is equal to a difference between values of the supply voltage and system ground as detected at the second positions of the positive and negative rails; and a first sense conductor connected to the remote sense line and to the output of the first differential amplifier, wherein the remote sense conductor of the power supply senses a voltage at the output of the first differential amplifier.

7. The computer system of claim 6, wherein the logic circuit includes at least one transistor.

8. An integrated circuit formed on a semiconductor substrate, comprising:

a first input conductor for coupling the integrated circuit to a first external supply voltage;

a first internal supply rail for supplying the first external supply voltage to the integrated circuit, wherein the input conductor is connected at a first position of the first internal supply rail; and a first sense conductor connected to a second position of the first internal supply rail wherein the second position of the first internal supply rail is separated by the first position of the first internal supply rail by at least one parasitic element, such that a value of the first external supply voltage at the first position of the first internal supply rail is different than a value of the first external supply voltage at the second position of the first internal supply rail, the first sense conductor for coupling the integrated circuit to remote sensing circuitry.

9. The integrated circuit of claim 8 further comprising:

a second input conductor for coupling the integrated circuit to a second external supply voltage;

a second internal supply rail for supplying the second external supply voltage to the integrated circuit, wherein the second input conductor is coupled at a first position of the second internal supply rail; and a second sense conductor coupled to a second position of the second internal supply rail wherein the second position of the second and internal supply rail is separated by the first position of the second internal supply rail by at least one parasitic element, such that a value of the first external supply voltage at the first position of the second internal supply rail is different than a value of the second external supply voltage at the second position of the second internal supply rail, the second conductor for coupling the integrated circuit to remote sensing circuitry.

10. The integrated circuit of claim 8 further comprising a circuit coupled at the second position of the first internal supply rail.

11. The integrated circuit of claim 9 further comprising a circuit coupled at the second positions of the first and second internal supply rails.

12. A remote sensing system comprising:

a power supply including:

an output for outputting a supply voltage;

a remote sense conductor for sensing a value of the supply voltage;

regulating circuitry coupled to the output and the remote sense conductor, the regulating circuitry for comparing the value of the supply voltage sensed by the remote sense conductor to a reference voltage, wherein the regulating circuitry adjusts the supply voltage such that the value of the supply voltage sensed by the remote sense conductor is equal to a reference voltage;

a supply output line coupled to the output of the power supply;

a remote sense line coupled to the remote sense conductor;

an integrated circuit comprising:

an input coupled to the supply output line for receiving the supply voltage;

an internal supply rail having a first position and a second position, wherein the first and second positions are separated by at least one parasitic element, for supplying an operating voltage to the integrated circuit, wherein the input is connected at the first position of the internal supply rail; and an output coupled to the remote sense line, wherein the output is coupled to the second position of the internal supply rail.

13. The integrated circuit of claim 1, wherein the first and second external sources are external to the integrated circuit.

14. The integrated circuit of claim 3, wherein the first and second external sources are external to the integrated circuit.

15. The integrated circuit of claim 9, wherein the first and second external supply voltages are external to the integrated circuit.

* * * * *